US012274345B2

(12) United States Patent
Kim et al.

(10) Patent No.: US 12,274,345 B2
(45) Date of Patent: Apr. 15, 2025

(54) COSMETIC CONTAINER

(71) Applicant: Kolmar Korea Co., Ltd., Sejong-si (KR)

(72) Inventors: Hyung Sang Kim, Sejong-si (KR); Chang Soo Lee, Sejong-si (KR); Koo Sup Ahn, Sejong-si (KR); Hye Jin Jung, Sejong-si (KR); Yeo Wool Lee, Sejong-si (KR)

(73) Assignee: Kolmar Korea Co., Ltd., Sejong-si (KR)

( * ) Notice: Subject to any disclaimer, the term of this patent is extended or adjusted under 35 U.S.C. 154(b) by 867 days.

(21) Appl. No.: 17/276,474

(22) PCT Filed: Nov. 9, 2018

(86) PCT No.: PCT/KR2018/013599
§ 371 (c)(1),
(2) Date: Mar. 15, 2021

(87) PCT Pub. No.: WO2020/054909
PCT Pub. Date: Mar. 19, 2020

(65) Prior Publication Data

US 2022/0031043 A1 Feb. 3, 2022

(30) Foreign Application Priority Data

Sep. 14, 2018 (KR) ..... 20-2018-0004293

(51) Int. Cl.
*A45D 33/24* (2006.01)
*A45D 40/22* (2006.01)
*A45D 40/00* (2006.01)

(52) U.S. Cl.
CPC ..... *A45D 33/24* (2013.01); *A45D 40/221* (2013.01); *A45D 2040/0006* (2013.01); *A45D 2200/05* (2013.01); *A45D 2200/1036* (2013.01)

(58) Field of Classification Search
CPC ..... A45D 33/025; A45D 33/06; A45D 33/24
See application file for complete search history.

(56) References Cited

U.S. PATENT DOCUMENTS

2016/0242529 A1* 8/2016 Oh ..... A45D 33/006
2017/0127799 A1* 5/2017 Chung ..... B65D 25/10
(Continued)

FOREIGN PATENT DOCUMENTS

JP 2016-534808 A 11/2016
KR 200464761 * 1/2013
(Continued)

*Primary Examiner* — Nicholas D Lucchesi
*Assistant Examiner* — Jennifer Gill
(74) *Attorney, Agent, or Firm* — Bridgeway IP Law Group, PLLC; Sang Ho Lee; Hyun Woo Shin

(57) ABSTRACT

An embodiment of the present invention provides a cosmetic container. The cosmetic container includes an outer container in which a first accommodating portion is formed, an inner container in which a second accommodating portion, in which an impregnation member impregnated with a cosmetic material is accommodated, is formed and which is detachably coupled to an inner side of the first accommodating portion of the outer container, and a coupling portion which is coupled to a circumference of the second accommodating portion and which has a first fixing portion formed to extend downward from one side of an upper surface toward an inner side of the second accommodating portion to prevent the impregnation member from coming out of the second accommodating portion.

20 Claims, 9 Drawing Sheets

(56) References Cited

U.S. PATENT DOCUMENTS

| | | | | |
|---|---|---|---|---|
| 2017/0238671 | A1* | 8/2017 | Berhault | A45D 33/02 |
| 2017/0280850 | A1* | 10/2017 | Lee | A45D 33/008 |
| 2017/0318938 | A1* | 11/2017 | Lee | A45D 33/06 |
| 2020/0196731 | A1* | 6/2020 | Lee | A45D 40/00 |

FOREIGN PATENT DOCUMENTS

| | | | | |
|---|---|---|---|---|
| KR | 10-1541682 | B1 | | 8/2015 |
| KR | 20-2015-0003748 | U | | 10/2015 |
| KR | 20-0484247 | Y1 | | 8/2017 |
| KR | 10-1795273 | B1 | | 11/2017 |
| KR | 20-2018-0001158 | U | | 4/2018 |
| KR | 10-1964533 | B1 | | 4/2019 |
| WO | WO 2015076646 | | * | 5/2015 |
| WO | 2015-141937 | A1 | | 9/2015 |
| WO | 2016-059246 | A1 | | 4/2016 |
| WO | 2017-179932 | A1 | | 10/2017 |
| WO | 2018-151372 | A1 | | 8/2018 |

* cited by examiner (a)

(b)

(a)

(b)

COSMETIC CONTAINER

TECHNICAL FIELD

The present invention relates to a cosmetic container, and more particularly, to a cosmetic container including an inner container that is easily detachable from an outer container and is capable of stably accommodating an impregnation member.

BACKGROUND ART

Makeup products are classified into base makeup products that are used to even out a skin tone or cover flaws and point makeup products that give a three-dimensional effect to parts of the face or body such as lips, eyes, and fingernails. The base makeup products include a makeup base, a foundation, powder, and the like, and the point makeup products include a lipstick, an eyeliner, a mascara, and the like.

The foundation is classified into a solid foundation, a liquid foundation, and a gel foundation according to the form of a cosmetic material. In the case of solid foundation, the coverage is high, but there is a disadvantage in that makeup becomes cakey when touching up makeup. Therefore, nowadays, many consumers prefer a liquid or gel foundation that lasts considerably long and has good adhesion when applied to the skin.

Accordingly, the development of containers for liquid or gel foundation has also become necessary. Generally, a glass container or a tubular container is filled with a liquid or gel foundation, and upon using the foundation, a user takes some foundation from the glass container or squeezes some foundation out of the tubular container onto his or her hand and then uses a puff or his or her hand to apply the foundation onto the skin. However, the related art has problems in that, since the user's hand gets stained with the cosmetic material every time the user uses the foundation, the user has to wash his or her hand every time and the cosmetic material is wasted.

In order to address such problems, a compact container has been introduced in which an impregnation member impregnated with a liquid or gel foundation is embedded in the compact container and an applicator such as a puff is used to apply the foundation, which is impregnated in the impregnation member, onto the skin.

For the compact container, there is a need to allow the impregnation member impregnated with the foundation to be separated and replaced when necessary and to stably fix the impregnation member in an accommodation space. Thus, conventionally, a ring-shaped fixer that is coupled to the accommodation space for the impregnation member and forms a step in a horizontal direction has been mainly used.

However, although such a fixer has no problem in fixing an impregnation member of which an upper surface and/or a lower surface are/is configured to be flat, the fixer has a limitation that it is not suitable for effectively supporting impregnation members having various other shapes. In particular, in a case in which an impregnation member is implemented in a convex shape in which a thickness increases in a direction from an edge to a central portion, there is a problem in that it is difficult to stably fix the impregnation member in the accommodation space using the fixer.

Therefore, there is a need for technology for addressing the above-mentioned problems.

DISCLOSURE

Technical Problem

The present invention is directed to providing a cosmetic container including an inner container that is easily detachable from an outer container and is capable of stably accommodating an impregnation member.

The technical objectives of the present invention are not limited to the above objective, and other objectives may become apparent to those of ordinary skill in the art from the following description.

Technical Solution

An embodiment of the present invention provides a cosmetic container. The cosmetic container includes an outer container in which a first accommodating portion is formed, an inner container in which a second accommodating portion, in which an impregnation member impregnated with a cosmetic material is accommodated, is formed and which is detachably coupled to an inner side of the first accommodating portion of the outer container, and a coupling portion which is coupled to a circumference of the second accommodating portion and which has a first fixing portion formed to extend downward from one side of an upper surface toward an inner side of the second accommodating portion to prevent the impregnation member from coming out of the second accommodating portion.

The coupling portion may further include a second fixing portion which is formed to be spaced outward from a front end of the first fixing portion and which presses an area of an upper surface of the impregnation member, which is different from an area pressed by the first fixing portion, to fix the impregnation member.

The second fixing portion may protrude more downward toward the inner side of the second accommodating portion than the first fixing portion.

The impregnation member may be formed to have edges bonded to each other and may be formed in a convex shape in which an upper surface and a lower surface are opposite to each other with a bonding portion disposed therebetween, and the first fixing portion and the second fixing portion may press an inclined inner circumferential portion of the bonding portion of the upper surface of the impregnation member.

The inner container may have a lower surface formed to convexly protrude downward so that the second accommodating portion has a shape that corresponds to the impregnation member, and the outer container may have a lower surface formed to convexly protrude downward so that the inner container is accommodated inside the first accommodating portion.

At least a portion of the lower surface of the outer container may be formed to be open so that at least a portion of the inner container accommodated in the first accommodating portion is exposed to the outside.

The second fixing portion may include one or more pressing protrusions, and at least one of the pressing protrusions may pass through the upper surface of the impregnation member to fix the impregnation member.

The first fixing portion may be formed so that at least a portion thereof is inclined toward the center of the second accommodating portion.

One or more fixing protrusions may be formed on an inner side surface of the first accommodating portion to protrude inward therefrom, one or more fixing grooves that correspond to the fixing protrusions may be formed in an outer side surface of the inner container, and when coupling the inner container, each of the fixing protrusions may be bound to one of the fixing grooves that corresponds thereto.

The cosmetic container may further include an inner cover coupled to seal the inner container, and a sealing portion configured to come into close contact with an inner side surface of an edge portion of the inner container to seal the inner container may be provided on one surface of the inner cover that is adjacent to the inner container.

The cosmetic container may further include an outer cover coupled to seal the outer container, the outer cover may be configured to rotate by a first hinge, the inner cover may be configured to rotate by a second hinge, and the first hinge and the second hinge may be configured to be spaced a predetermined angle apart from each other.

A third accommodating portion that is recessed inward may be formed on one surface of the inner cover that is opposite to the inner container.

The cosmetic container may further include an applicator accommodated in the third accommodating portion.

Advantageous Effects

According to the present invention, a coupling portion is coupled to an upper portion of an inner container, and a fixing portion of the coupling portion supports an impregnation member, which is disposed inside the inner container and impregnated with a cosmetic solution, from an upper side to stably fix the impregnation member and prevent the impregnation member from coming out of the inner container. In particular, the fixing portion is provided as a plurality of fixing portions, and a protruding length of the fixing portions increases outward to more stably fix the impregnation member having a convex shape.

Also, according to the present invention, a plurality of pressing protrusions are formed at a front end of a second fixing portion of the coupling portion disposed at an outer side, and at least some of the pressing protrusions are made to penetrate a mesh structure of the impregnation member to maximize a fixing force for the impregnation member.

Also, according to the present invention, since, when accommodating the impregnation member in the inner container, an exposed portion of the impregnation member has a form in which the center convexly protrudes upward, a residual cosmetic material, which is discharged from the impregnation member but not applied on an applicator, can be collected around the impregnation member and effectively absorbed into the impregnation member again instead of leaking to the outside.

DESCRIPTION OF DRAWINGS

A brief description of each drawing will be provided for better understanding of the drawings referenced in the detailed description of the present invention.

MODES OF THE INVENTION

Figure 1:
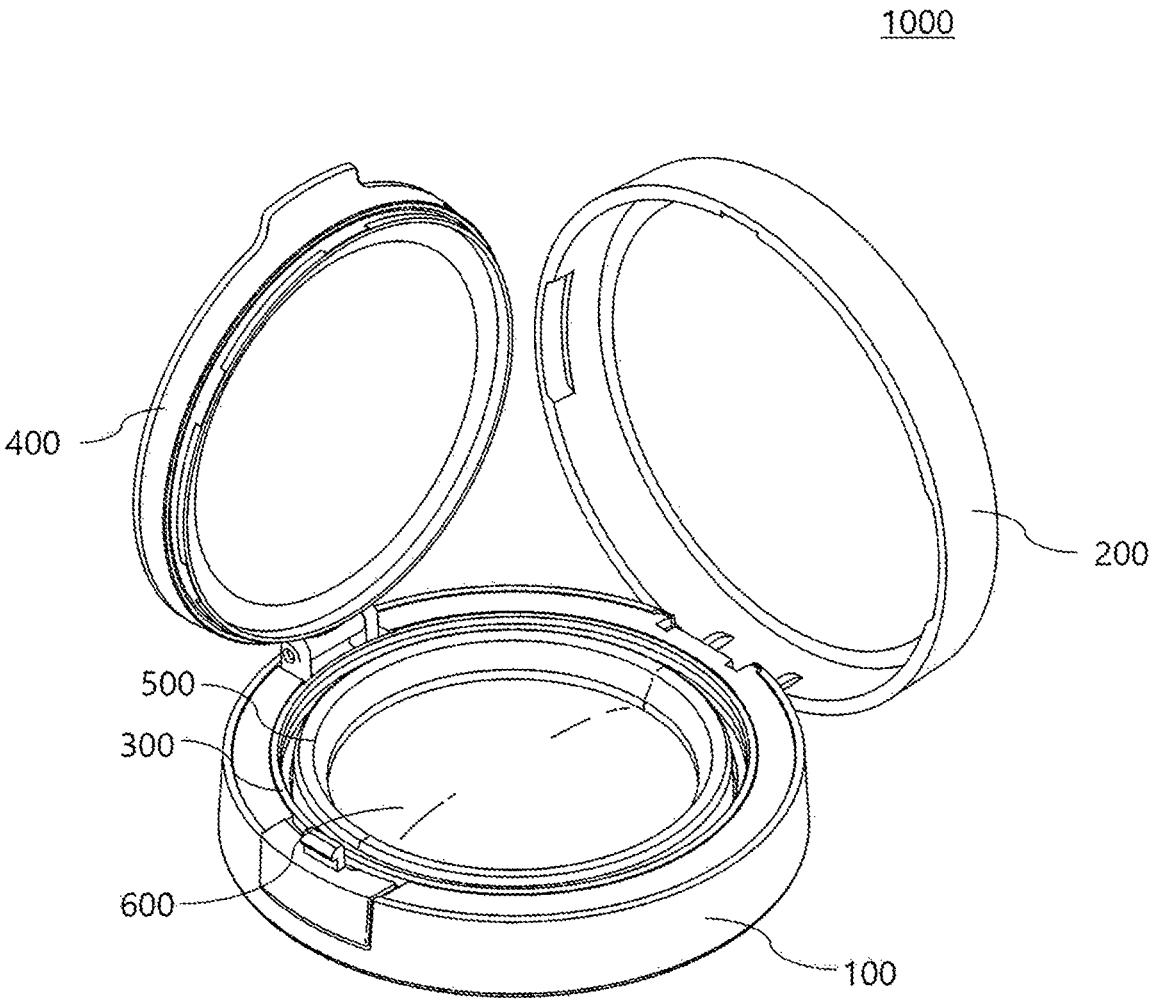
FIG. 1 illustrates a cosmetic container according to an embodiment of the present invention.

Hereinafter, embodiments according to the present invention will be described with reference to the accompanying drawings. In assigning reference numerals to elements of each drawing, it should be noted that the same reference numerals are assigned to the same elements as much as possible even when the elements are illustrated in different drawings. Also, in describing the embodiments of the present invention, when detailed description of a related known configuration or function is determined as interfering with the understanding of the embodiments of the present invention, the detailed description thereof will be omitted. In addition, although the embodiments of the present invention will be described below, the technical idea of the present invention is not limited thereto, and the embodiments may be modified and embodied in various other ways by those of ordinary skill in the art.

Throughout the specification, when a certain part is described as being "connected" to another part, this includes a case in which the certain part is "indirectly connected" to the other part while another element is present therebetween as well as a case in which the certain part is "directly connected" to the other part. Throughout the specification, when a certain part is described as "including" a certain element, this signifies that the certain part may further include another element rather than excluding the other element unless particularly described otherwise. Also, in describing elements of the embodiments of the present invention, terms such as first, second, A, B, (a), and (b) may be used. The terms are only intended to distinguish one element from another element, and the essence, order, sequence, or the like of the corresponding element is not limited by the terms.

Figure 2:
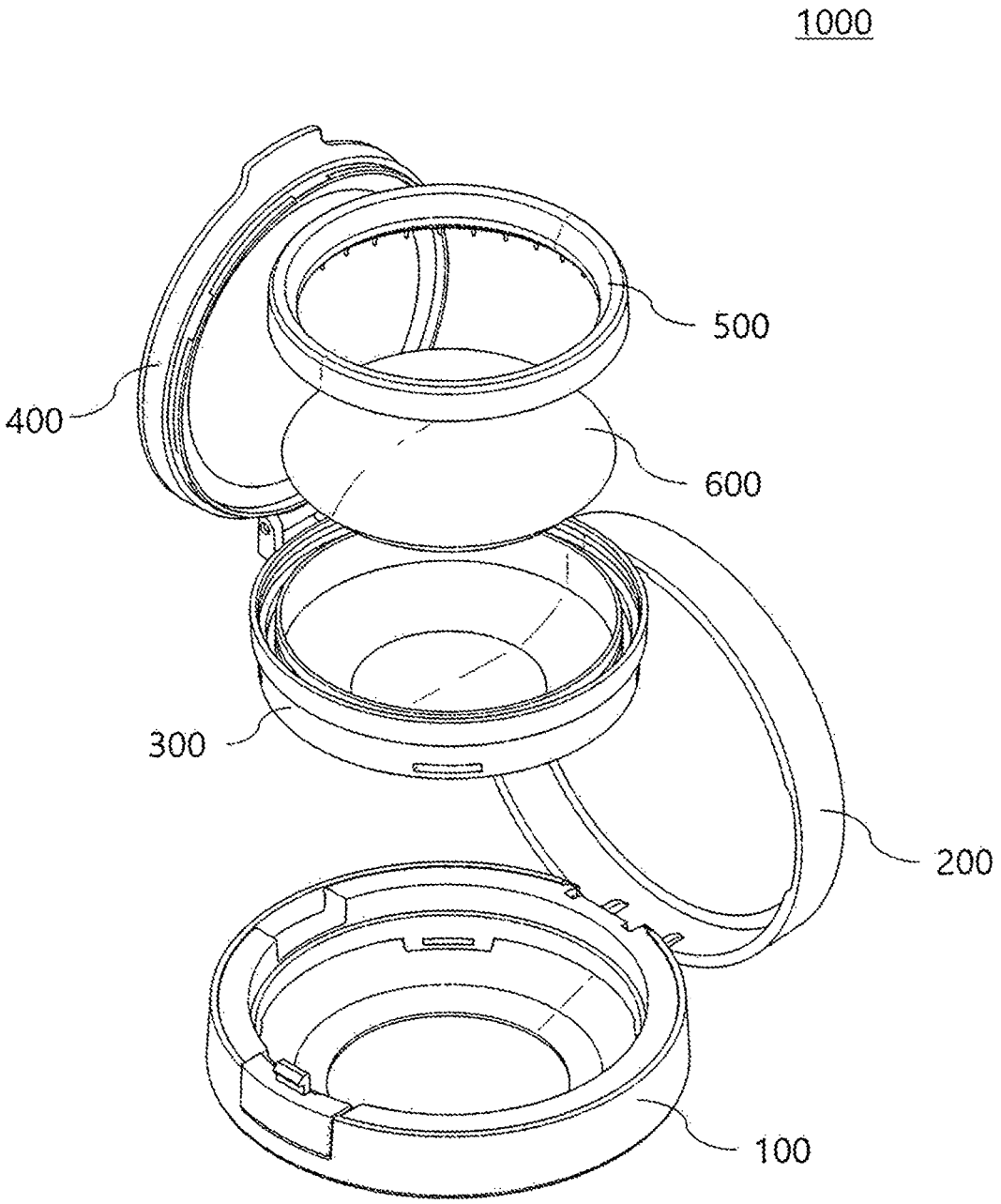
FIG. 2 illustrates an exploded state of the cosmetic container of FIG. 1.
Figure 3:
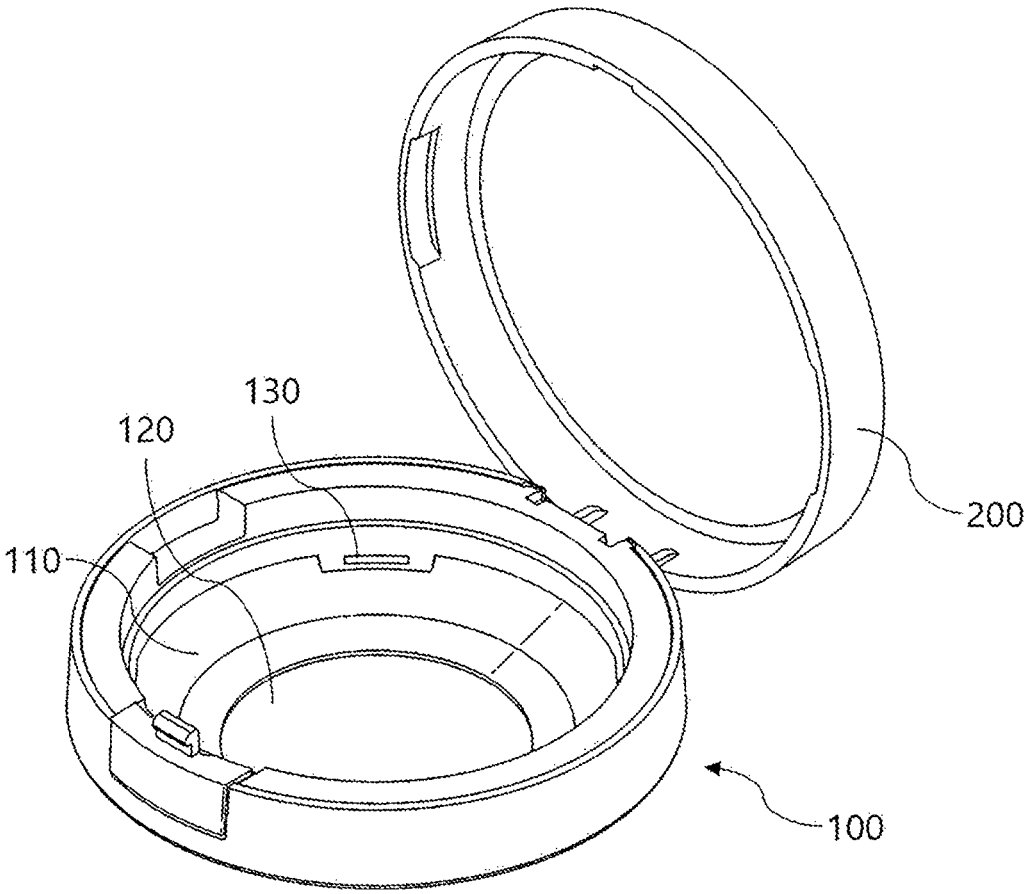
FIG. 3 illustrates an outer container and an outer cover of the cosmetic container of FIG. 1.
Figure 4:
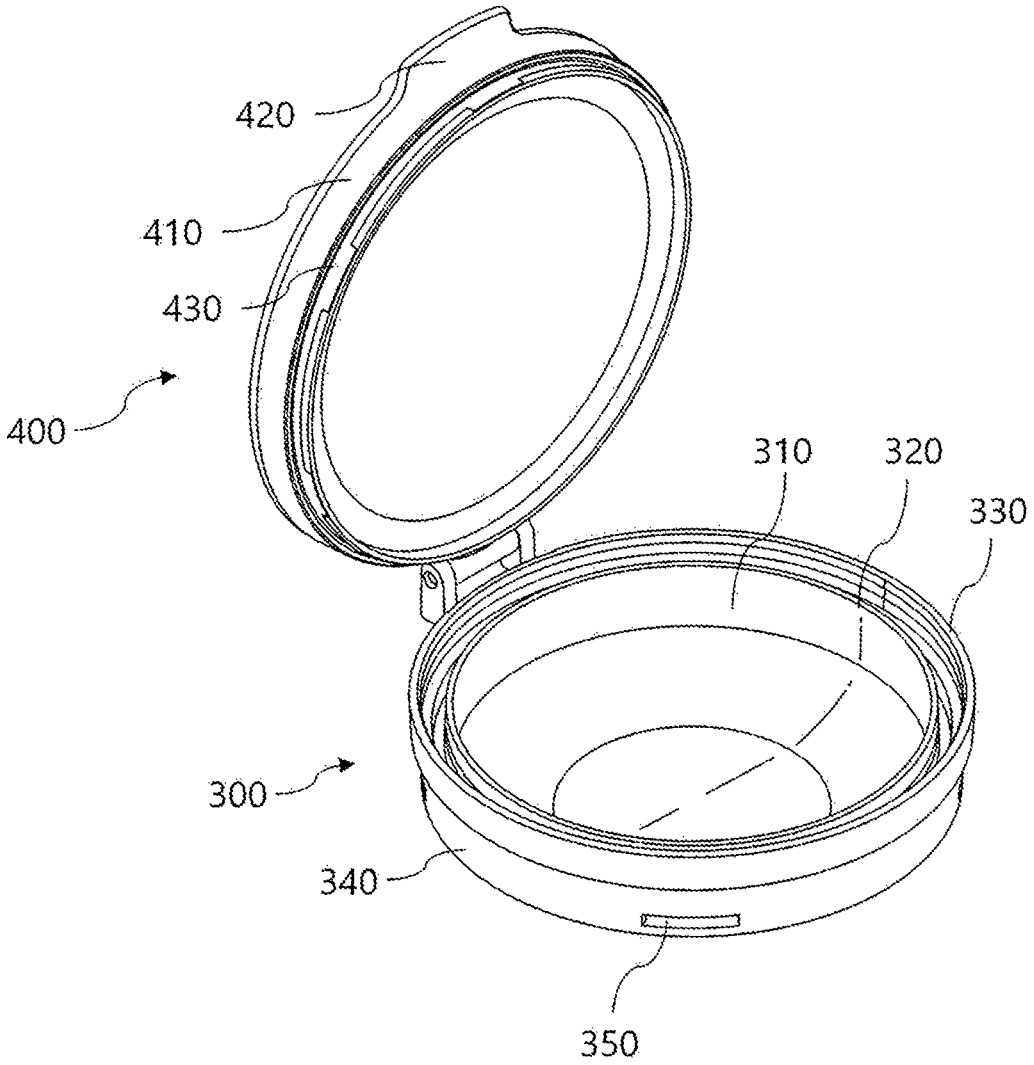
FIG. 4 illustrates an inner container and an inner cover of the cosmetic container of FIG. 1.
Figure 5:
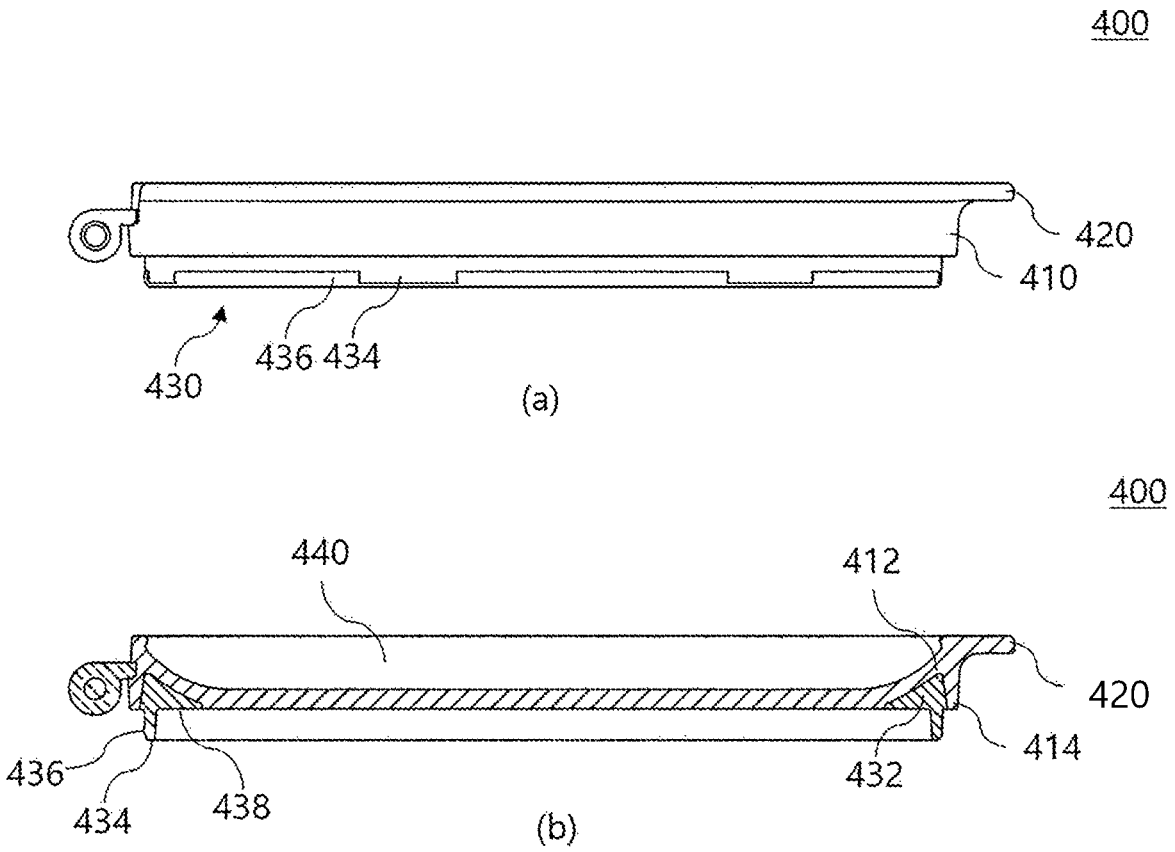
FIG. 5 illustrates a lateral view and a lateral cross-sectional view of the inner cover of the cosmetic container of FIG. 1.
Figure 6:
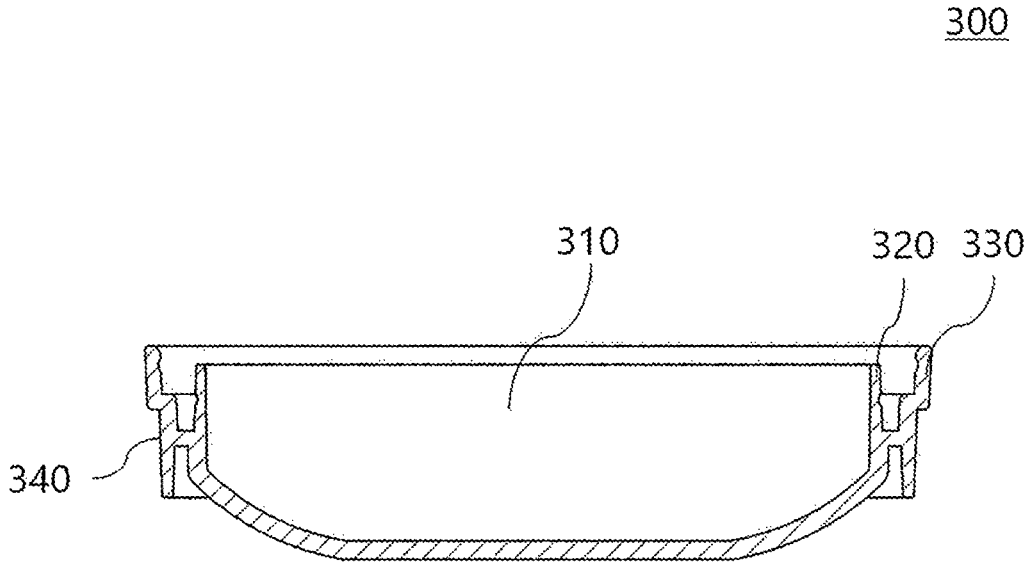
FIG. 6 illustrates the inner container of the cosmetic container of FIG. 1.

FIG. 1 illustrates a cosmetic container according to an embodiment of the present invention, FIG. 2 illustrates an exploded state of the cosmetic container of FIG. 1, FIG. 3 illustrates a perspective view of an outer container and an outer cover of the cosmetic container of FIG. 1, FIG. 4 illustrates a perspective view of an inner container and an inner cover of the cosmetic container of FIG. 1, FIG. 5 illustrates a lateral view and a lateral cross-sectional view of the inner cover of the cosmetic container of FIG. 1, and FIG. 6 illustrates a cross-sectional view of the inner container of the cosmetic container of FIG. 1.

Referring to FIGS. 1 to 6, a cosmetic container 1000 may include an outer container 100, an outer cover 200, an inner container 300, an inner cover 400, a coupling portion 500, and an impregnation member 600.

The outer container 100 is configured to accommodate various components in the cosmetic container 1000. In particular, a first accommodating portion 110 may be formed in the outer container 100 so as to accommodate the inner container 300 therein. The first accommodating portion 110 may have a shape that corresponds to an outer shape of the inner container 300, and one or more fixing protrusions 130 configured to fix coupling with the inner container 300 may be formed on an inner side surface of the first accommodating portion 110. An opening 120 may be formed in a lower surface of the outer container 100. That is, the opening 120, in which at least a portion of the lower surface of the outer container 100 is open toward an inner side of the first accommodating portion 110, may be formed, and at least a portion of a lower surface of the inner container 300 accommodated in the first accommodating portion 110 may be exposed to the outside of the outer container 100 through the opening 120. Accordingly, by pressing an area of the inner container 300 exposed to the outside upward, a user may easily separate the inner container 300 from the first accommodating portion 110 of the outer container 100.

The outer cover 200 may be coupled to seal the outer container 100. For example, the outer cover 200 may be coupled to one side of the outer container 100 through a first hinge and may rotate by the first hinge to seal or open the outer container 100. Meanwhile, a locking portion (not denoted by a reference numeral) configured to maintain a sealed state of the outer cover 200 may be formed at a position where the outer container 100 and the outer cover 200 correspond to each other (for example, a side opposite to the first hinge).

The inner container 300 is a container in which the impregnation member 600 is accommodated and may be detachably coupled to the first accommodating portion 110 of the outer container 100. For example, in order to allow the inner container 300 to be seated in the first accommodating portion 110 of the outer container 100, at least a portion of the inner container 300 may have a shape that corresponds to the first accommodating portion 110, and one or more fixing grooves 350 that correspond to the fixing protrusions 130 of the first accommodating portion 110 may be formed in an outer side surface of the inner container 300. When the inner container 300 is inserted into the first accommodating portion 110, the fixing protrusions 130, each of which corresponds to one of the fixing grooves 350 of the inner container 300, are bound to the fixing grooves 350 to fix coupling between the inner container 300 and the outer container 100.

A second accommodating portion 310 configured to accommodate the impregnation member 600 may be formed in the inner container 300. To this end, at least a portion of the second accommodating portion 310 may have a shape that corresponds to the impregnation member 600. The coupling portion 500 is coupled to the circumference of the second accommodating portion 310 to support the impregnation member 600 and prevent the impregnation member 600 from coming out of the second accommodating portion 310.

A first edge portion 320 and a second edge portion 330 which is disposed to be spaced apart outward from the first edge portion 320 may be formed on an upper portion of the inner container 300. For example, the first edge portion 320 may be formed along the circumference of the second accommodating portion 310 in order to be coupled with the coupling portion 500 for supporting the impregnation member 600, and the second edge portion 330 may be coupled as the inner cover 400 seals the inner container 300. A third edge portion 340 may be formed along a circumference of a lower portion of the inner container 300. For example, the third edge portion 340 may be formed to be spaced apart outward from and to surround a lower end portion of the inner container 300 that forms the second accommodating portion 310. In one embodiment, the third edge portion 340 may be configured to be continuous with the second edge portion 330 at the upper portion of the inner container 300 but formed to be closer to the second accommodating portion 310 than the second edge portion 330 (that is, an outer diameter thereof is formed smaller than that of the second edge portion 330) such that a step (not denoted by a reference numeral) is formed at a connection portion between the second edge portion 330 and the third edge portion 340. When coupling the inner container 300, the step may be seated on a step formed to correspond to the first accommodating portion 110.

The inner cover 400 is configured to open and seal the inner container 300 and may include a cover main body 410, a handle portion 420, a sealing portion 430, and a third accommodating portion 440. The inner cover 400 may be coupled to one side of the inner container 300 through a second hinge and may rotate by the second hinge to seal or open the inner container 300. Here, in order to prevent interference, the second hinge may be implemented to be spaced a predetermined angle apart from the first hinge when the inner container 300 and the outer container 100 are coupled.

The cover main body 410 may be connected to the second hinge and allow the inner cover 400 to rotate, may seal and open at least a portion of the inner container 300, and may provide a space in which the handle portion 420, the sealing portion 430, and the third accommodating portion 440 are formed and combined.

The handle portion 420 may be formed to protrude to the outside of the cover main body 410. The handle portion 420 is configured to be gripped by a user, and the user may rotate the inner cover 400 through the handle portion 420 to open and seal the inner container 300 easily. In order to facilitate the rotation, the handle portion 420 may be formed at the opposite side of the second hinge, but the present invention is not limited thereto.

The sealing portion 430 configured to seal the inner container 300 may be provided on a bottom surface of the cover main body 410 (that is, adjacent to the inner container 300). Unlike conventional sealing components which are made of a hard plastic material or made by combining the hard plastic material with a buffer portion made of a soft material, the sealing portion 430 of the present invention may be entirely made of a soft material, such as rubber, urethane, and silicone, to provide a greater sealing force and facilitate manufacture.

Specifically, the sealing portion 430 may be formed along the circumference of the cover main body 410 and may have an open central portion. In particular, a close-contact protrusion 432 that protrudes toward the cover main body 410 may be formed along the circumference of the sealing portion 430. A close-contact groove 412 may be formed along the circumference of the bottom surface of the cover main body 410 so as to correspond to the close-contact protrusion 432. By increasing a contact area for coupling between the cover main body 410 and the sealing portion 430 (that is, an adhesive material application area) through the close-contact groove 412 and the close-contact protrusion 432, the sealing portion 430 may be more firmly coupled to the cover main body 410.

Also, a sealing protrusion 434 may be provided to be formed along the circumference of the sealing portion 430 and to protrude downward. When the sealing portion 430 is coupled to the inner container 300 due to the rotation of the second hinge, the sealing protrusion 434 may come into close contact with an inner side surface of the second edge portion 330 to seal the inner container 300. For firm sealing, an outer diameter of the sealing protrusion 434 may be formed to be larger than an inner diameter of the second edge portion 330, but the present invention is not limited thereto.

A plurality of coupling protrusions 436 may be formed on an outer side of the sealing protrusion 434. The plurality of coupling protrusions 436 may be formed by a plurality of areas of an outer side surface of the sealing protrusion 434 protruding outward and may be spaced apart from each other in a circumferential direction. Coupling grooves that correspond to the coupling protrusions 436 may be formed in an inner surface of the second edge portion 330 of the inner container 300, and consequently, when the sealing portion 430 is coupled to the inner container 300, the coupling protrusions 436 may be inserted into the coupling grooves, and thus, while the sealing portion 430 is fixed to the inner container 300, sealing of the inner container 300 may be achieved.

Meanwhile, unlike the plurality of coupling protrusions 436 which are formed to be spaced apart from each other, the coupling grooves may be integrally formed along the circumference. That is, when the coupling protrusions 436 are inserted into the coupling groove due to the coupling between the inner cover 400 and the inner container 300, air compressed between the inner cover 400 and the inner container 300 may be allowed to flow to the outside through an area of the outer side surface of the sealing protrusion 434 where the coupling protrusion 436 is not formed and through a coupling groove that corresponds thereto. After the coupling protrusions 436 are inserted into the coupling groove, the sealing protrusion 434 may be in solid close contact with the inner side surface of the second edge portion 330 along the circumference thereof to maintain the sealing of the inner container 300. In this way, the air compression (that is, internal pressure) between the inner cover 400 and the inner container 300, which may occur upon sealing, may be effectively addressed, and thus the inner cover 400 may seal the inner container 300 easily and stably.

The third accommodating portion 440 may be formed on one surface of the cover main body 410 that is opposite to the inner container 300. The third accommodating portion 440 may be formed by the cover main body 410 being recessed inward, and an applicator for applying a cosmetic material, such as a puff or a brush, may be accommodated in the third accommodating portion 440.

According to an embodiment, a sealing bottom surface 438 of the sealing portion 430 that is at an inner side of the sealing protrusion 434 may provide additional sealing. Specifically, when the inner cover 400 seals the inner container 300, the sealing bottom surface 438 may press an upper surface of the coupling portion 500 that is inserted onto the first edge portion 320 of the inner container 300. In this way, the sealing bottom surface 438 may firstly seal the impregnation member 600 at an inner side of the coupling portion 500 and thus allow the sealing portion 430 to provide double sealing.

The coupling portion 500 may be coupled to the first edge portion 320 of the inner container 300 and may press or support at least a partial area of the impregnation member 600, which is accommodated in the second accommodating portion 310 and has a cosmetic material impregnated therein, to fix the impregnation member 600 and prevent the impregnation member 600 from coming out of the second accommodating portion 310. The coupling portion 500 may be formed in a ring shape that has an open central portion so that the impregnation member 600 is exposed to the outside through the open upper surface of the second accommodating portion 310, but the present invention is not limited thereto.

The impregnation member 600 may be accommodated in the second accommodating portion 310 of the inner container 300 in a state in which a cosmetic material is impregnated in the impregnation member 600. The cosmetic material impregnated in the impregnation member 600 may be applied on a cosmetic applicator (for example, a puff or the like) and used. Here, various examples of the cosmetic material include a lotion, a milk lotion, a moisturizing lotion, a nourishing lotion, a skin lotion, a skin softener, a skin toner, an astringent, a massage cream, a nourishing cream, a moisturizing cream, a sunscreen, an essence, sun milk, a blemish balm (BB) cream, a base, a foundation, a color correcting (CC) cream, sunblock, blush, concealer, eyeshadow, an eyebrow tint, and the like. The cosmetic material is preferably a liquid or gel, but at least some of the above-listed cosmetic materials may be non-liquid (that is, solid or semisolid).

The impregnation member 600 is made of a porous material, is impregnated with a cosmetic material, and allows the impregnated cosmetic material to be discharged when an external force is applied thereto. For example, the impregnation member 600 may be made of one or more materials selected from the group consisting of natural rubber, synthetic resin, polyurethane, latex, acrylonitrile-butadiene rubber (NBR), butadiene rubber (BR), styrene-butadiene rubber (SBR), chloroprene rubber (CR), butyl rubber (IIR), isoprene rubber (IR), vulcanized ethylene-propylene rubber (EPR), polysulfide rubber, silicone rubber, fluoro-rubber, urethane rubber, acrylic rubber, ethylene propylene diene monomer (EPDM) rubber, polyvinyl alcohol (PVA) and ethyl vinyl acetate (EVA), nitrile rubber, and a mixture thereof, but the present invention is not limited thereto. According to an embodiment, the impregnation member 600 may be made of one or more fibers selected from the group consisting of a natural fiber, an artificial fiber, and a mixture thereof.

The impregnation member 600 may be formed in a convex shape in which an upper surface 610 and a lower surface 620 protrude in opposite directions, and the upper surface 610 and the lower surface 620 may constitute a mesh structure in which a plurality of discharge holes are formed to allow the impregnated cosmetic material to be discharged to the outside. Here, the discharge hole may have various shapes such as a circular shape and a polygonal shape. The mesh structure may be formed by weaving yarn or formed using foam or a sponge, but the present invention is not limited thereto, and various other configurations may be applied to form the discharge holes.

In consideration of the shape of the impregnation member 600, the inner container 300 may have a lower surface that convexly protrudes downward so that the second accommodating portion has a shape that corresponds to the impregnation member 600, and the outer container 100 may also have a lower surface that convexly protrudes downward so that the inner container 300 is accommodated in the first accommodating portion 110.

Also, when the impregnation member 600 is accommodated in the second accommodating portion 310, a circumferential portion of the impregnation member 600 may be pressed and supported by the coupling portion 500, and the central portion of the convex shape of the impregnation member 600 may protrude upward and be exposed to a user when the inner cover 400 is opened.

The coupling portion 500 and the impregnation member 600 will be further described below with reference to FIGS. 7, 8, and 9.

Meanwhile, the shape of the cosmetic container 1000 illustrated in FIGS. 1 to 6 is only illustrative, and various other shapes may be applied according to an embodiment to which the present invention is applied.

Figure 7:
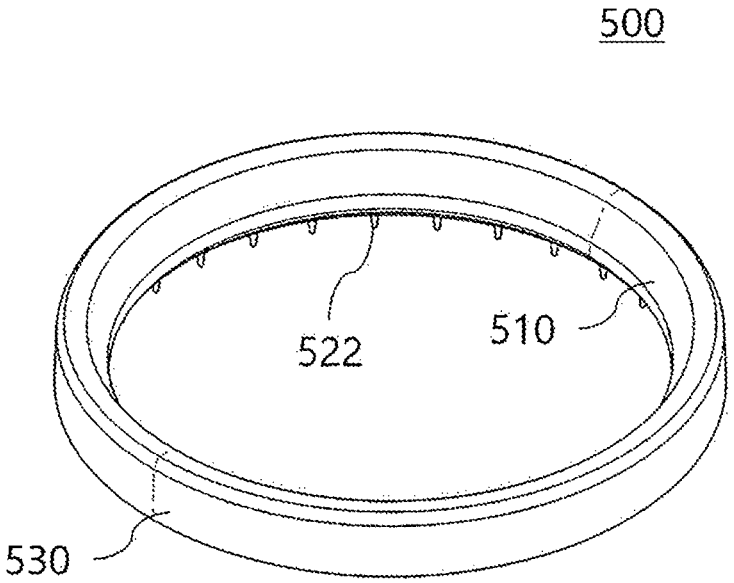
FIGS. 7 and 8 illustrate a coupling portion of the cosmetic container of FIG. 1.
Figure 7:
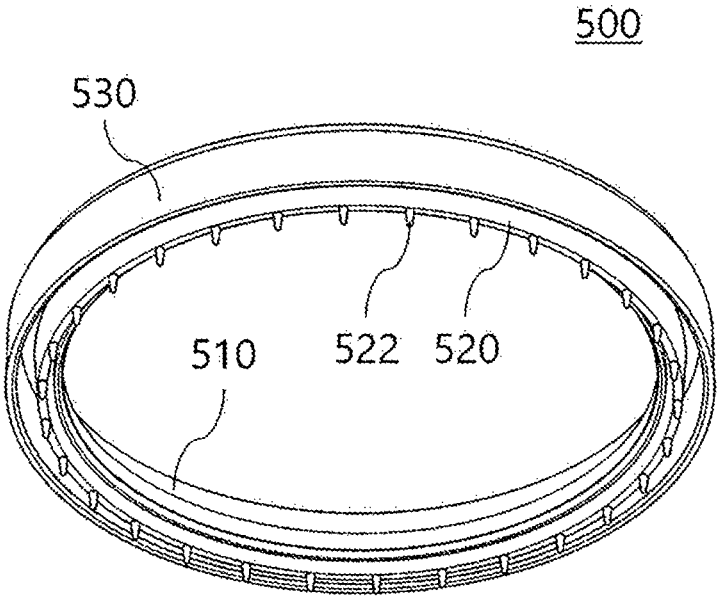
Figure 8:
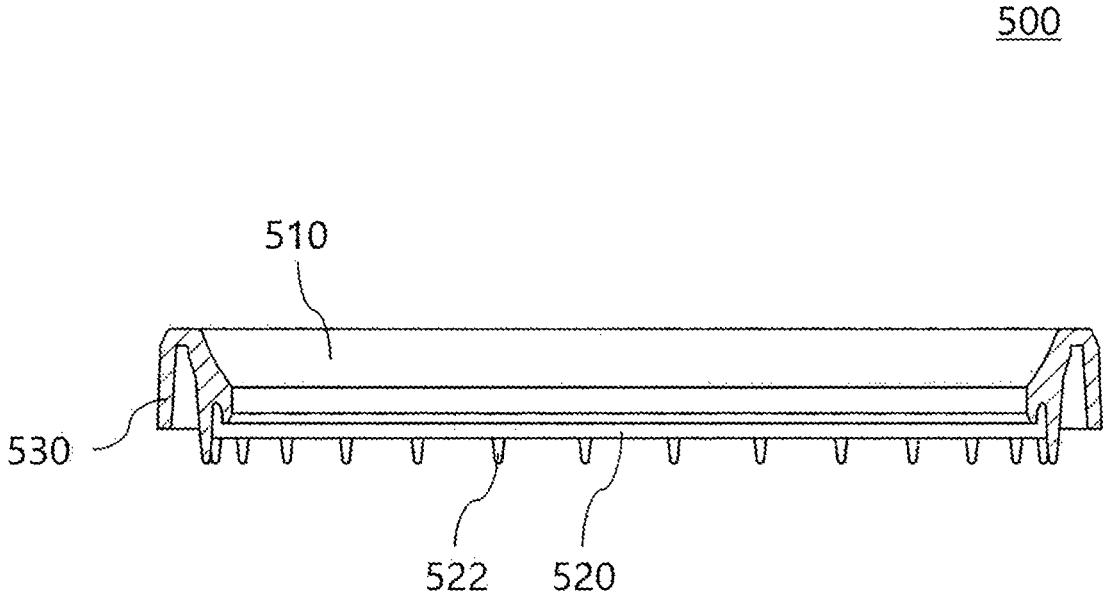

FIGS. 7 and 8 illustrate the coupling portion of the cosmetic container of FIG. 1. More specifically, FIG. 7 illustrates a top perspective view of the coupling portion (FIG. 7A) and a bottom perspective view of the coupling portion (FIG. 7B), and FIG. 8 illustrates a cross-sectional view of the coupling portion.

Referring to FIGS. 7 and 8, the coupling portion 500 is configured in a ring shape, and a first fixing portion 510 and a second fixing portion 520 may be formed in the coupling portion 500 to press or support the impregnation member 600 accommodated in the second accommodating portion 310 of the inner container 300.

The first fixing portion 510 may be configured to extend downward from one side of the upper surface of the coupling portion 500 (for example, an inner side of the ring shape) toward an inner side of the second accommodating portion 310, and a front end of the first fixing portion 510 may come into close contact with one area of the impregnation member 600 and may press and support the corresponding area. In one embodiment, the first fixing portion 510 may be formed so that at least a portion thereof is inclined toward the center of the second accommodating portion 310. This is in consideration of the fact that the circumference of the upper surface of the impregnation member 600 according to the present invention is formed to be inclined. In this way, the first fixing portion 510 may support the impregnation member 600 more stably and may secure a space for formation of the second fixing portion 520.

The second fixing portion 520 may be formed to be spaced outward from the front end of the first fixing portion 510 and may press (and/or support) an area of the upper surface of the impregnation member 600, which is different from an area pressed and/or supported by the first fixing portion 510, to fix the impregnation member 600. Since the area pressed by the second fixing portion 520 is located closer to the edge of the impregnation member 600 than the area pressed by the first fixing portion 510, the second fixing portion 520 may be configured to protrude more downward toward the inner side of the second accommodating portion 310 than the first fixing portion 510.

The second fixing portion 520 may include one or more pressing protrusions 522. For example, the pressing protrusions 522 may be disposed on a front end surface of the second fixing portion 520 so as to be spaced apart from each other along the circumference of the second accommodating portion 310. The pressing protrusions 522 may press and/or pass through the upper surface of the impregnation member 600 to fix the impregnation member 600 and prevent the impregnation member 600 from moving or falling.

According to an embodiment, the coupling portion 500 may press and/or penetrate the impregnation member 600 in a state in which the coupling portion 500 is coupled to the inner container 300 or may press and/or penetrate the impregnation member 600 when the impregnation member 600 is separated from the inner container 300 so as to prevent the impregnation member 600 from falling.

A fourth edge portion 530 may be formed to extend downward from the other side of the upper surface of the coupling portion 500 (for example, an outer side of the ring shape). In one embodiment, the first edge portion 320 of the inner container 300 may be inserted and fitted into a separation space between the first fixing portion 510 and/or the second fixing portion 520 and the fourth edge portion 530 so that the coupling portion 500 is coupled to the inner container 300.

Figure 9:
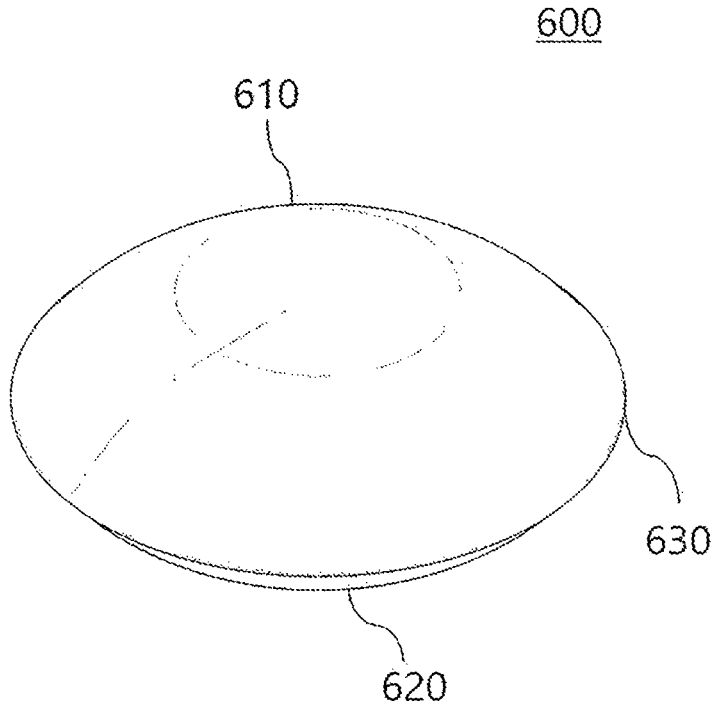
FIG. 9 illustrates an impregnation member of the cosmetic container of FIG. 1.
Figure 9:
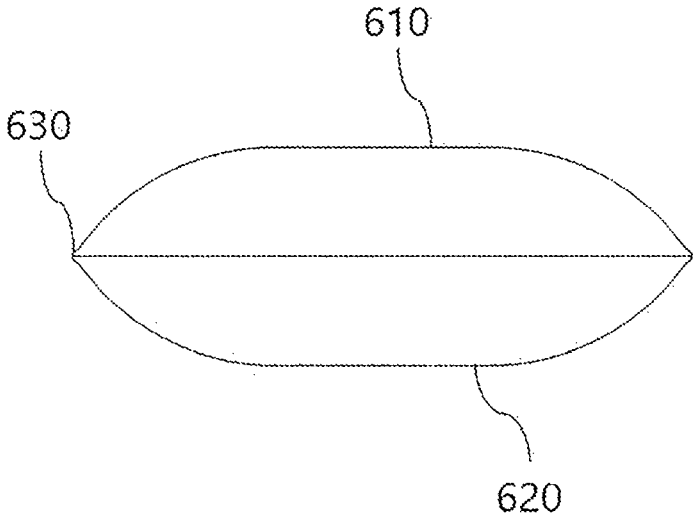

FIG. 9 illustrates the impregnation member of the cosmetic container of FIG. 1.

Referring to FIG. 9, the impregnation member 600 may be formed to have edges 630 bonded to each other. The bonding may be performed in various ways according to an embodiment to which the present invention is applied. For example, the bonding may be performed using an adhesive material, external heat binding in which heat is applied from the outside, internal heat binding in which heat is generated from the inside, and the like. In this way, the impregnation member 600 according to the present invention may prevent leakage of a cosmetic material through the outer circumference thereof and contamination of the cosmetic container due to the leakage and may eliminate user inconvenience and the like.

In this way, due to the edges 630 being bonded to each other, the impregnation member 600 may have a convex shape in which the upper surface 610 and the lower surface 620 are opposite to each other with the bonded edges 630 disposed therebetween. Accordingly, the upper surface 610 of the impregnation member 600 may have at least a partial area that is inclined downward in a direction toward the edge 630, and the lower surface 620 of the impregnation member 600 may have at least a partial area that is inclined upward in a direction toward the edge 630. In particular, in the impregnation member 600, an inner circumferential portion of the edge 630 may be formed to be inclined downward or upward in a direction toward the edge 630 as described above.

In the present invention, the first fixing portion 510 and the second fixing portion 520 of the coupling portion 500 may be implemented to press an inclined inner circumferential portion of the edge 630 of the upper surface of the impregnation member 600 to fix the impregnation member 600. Here, the coupling portion 500 is configured so that the second fixing portion 520, which is disposed at an outer side, protrudes more downward toward the inner side of the second accommodating portion 310 than the first fixing portion 510. In this way, the coupling portion 500 may effectively press the inclined circumferential portion to stably fix the impregnation member 600 to the inside of the second accommodating portion 310.

Exemplary embodiments have been disclosed herein and in the drawings. Although specific terms have been used herein, the terms are only used for the purpose of describing the present invention and are not intended to limit meanings or limit the scope of the present invention described in the claims below. Therefore, those of ordinary skill in the art should understand that various modifications and other equivalent embodiments are possible. Accordingly, the actual technical scope of the present invention should be defined by the technical idea of the attached claims.

The invention claimed is:

1. A cosmetic container comprising:

an outer container including a first accommodating portion;

an impregnation member impregnated with a cosmetic material, wherein at least a part of an upper surface of the impregnation member has a convex shape with a continuous decrease in thickness towards a distal edge;

an inner container detachably coupled to an inner side of the first accommodating portion of the outer container, the inner container having:

a second accommodating portion accommodating the impregnation member, and an inner cover rotatably attached to the second accommodating portion, the inner cover having:

a cover main body having a first material, and a sealing portion disposed along a circumference of the cover main body and having an open central portion, the sealing portion configured to seal the second accommodating portion when closed, and an entirety of the sealing portion made of a second material, wherein the second material is different and softer than the first material; and a coupling portion coupled to a circumference of the second accommodating portion and including:

a first fixing portion extending downward, and preventing the impregnation member from coming out of the second accommodating portion; and a second fixing portion spaced outward from the first fixing portion, wherein the first fixing portion and the second fixing portion are positioned to apply pressure on different points of the convex shape of the upper surface of the impregnation member.

2. The cosmetic container of claim 1, wherein the second fixing portion protrudes further downward toward the inner side of the second accommodating portion than the first fixing portion.

3. The cosmetic container of claim 2, wherein:

an edge of the upper surface and an edge of a lower surface of the impregnation member are opposite to each other and forms a bonding portion disposed between the upper surface and the lower surface; and the first fixing portion and the second fixing portion press a circumferential portion of the bonding portion of the upper surface of the impregnation member.

4. The cosmetic container of claim 3, wherein a lower surface of the inner container convexly protrudes downward, and the second accommodating portion has a shape that corresponds to the impregnation member, and wherein a lower surface of the outer container convexly protrudes downward and the inner container is accommodated inside the first accommodating portion.

5. The cosmetic container of claim 4, wherein at least a portion of the lower surface of the outer container is open and at least a portion of the inner container accommodated in the first accommodating portion is exposed to an outside.

6. The cosmetic container of claim 1, wherein the second fixing portion includes one or more pressing protrusions, and at least one of the pressing protrusions passes through the upper surface of the impregnation member to fix the impregnation member.

7. The cosmetic container of claim 1, wherein at least a portion of the first fixing portion is inclined toward a center of the second accommodating portion.

8. The cosmetic container of claim 1, wherein one or more fixing protrusions are disposed on an inner side surface of the first accommodating portion to protrude inward therefrom, one or more fixing grooves that correspond to the fixing protrusions are disposed in an outer side surface of the inner container, and when coupling the inner container with the first accommodating portion, each of the fixing protrusions is bound to one of the fixing grooves that corresponds thereto.

9. The cosmetic container of claim 1, wherein the sealing portion configured to come into contact with an inner side surface of an edge portion of the inner container is provided on one surface of the inner cover that is adjacent to the inner container, and wherein the sealing portion is made of at least one of natural rubber, urethane rubber, and silicone rubber.

10. The cosmetic container of claim 9, further comprising an outer cover coupled to the outer container and configured to seal the outer container, wherein the outer cover is configured to rotate by a first hinge, the inner cover is configured to rotate by a second hinge, and the first hinge and the second hinge are configured to be spaced a predetermined angle apart from each other.

11. The cosmetic container of claim 9, wherein one surface of the inner cover opposite to the inner container has a third accommodating portion that is recessed inward, and wherein the third accommodating portion is configured to accommodate an applicator.

12. The cosmetic container of claim 1, wherein the inner container further comprises a first edge portion, and wherein the coupling portion further comprises an edge portion defined to extend downward from the upper surface of the coupling portion and the first edge portion of the inner container is configured to be detachably inserted and fitted into a separation space between the edge portion and the second fixing portion.

13. The cosmetic container of claim 1, wherein inner container further comprises a first edge portion and a second edge portion which is disposed to be spaced apart outward from the first edge portion on an upper portion of the inner container, and the first edge portion is defined along the circumference of the second accommodating portion and is configured to be coupled with the coupling portion, and the second edge portion is configured to be coupled to the inner cover.

14. The cosmetic container of claim 1, wherein a center of the impregnation member has a flat shape, and the convex shape is located at circumferential area.

15. The cosmetic container of claim 1, wherein the impregnation member is made of one or more materials selected from the group consisting of: natural rubber, synthetic resin, latex, acrylonitrile-butadiene rubber (NBR), butadiene rubber (BR), styrene-butadiene rubber (SBR), chloroprene rubber (CR), butyl rubber (IIR), isoprene rubber (IR), vulcanized ethylene-propylene rubber (EPR), polysulfide rubber, silicone rubber, fluoro-rubber, urethane rubber, acrylic rubber, ethylene propylene diene monomer (EPDM) rubber, polyvinyl alcohol (PVA), ethyl vinyl acetate (EVA), and nitrile rubber.

16. The cosmetic container of claim 1, wherein the sealing portion has a close-contact protrusion that protrudes toward the cover main body, and the cover main body has a close-contact groove to receive the close-contact protrusion.

17. The cosmetic container of claim 1, wherein the sealing portion has at least one sealing protrusion that protrudes in a direction opposite to the cover main body, and the at least one sealing protrusion is configured to come into close contact with an inner side surface of a second edge portion to detachably seal the inner container.

18. The cosmetic container of claim 17, wherein the inner container further comprises a first edge portion and a second edge portion, wherein the second edge portion is disposed to be spaced apart outward from the first edge portion on an upper portion of the inner container; the first edge portion is defined along the circumference of the second accommodating portion and is configured to be coupled with the coupling portion; and the second edge portion is configured to be coupled to the inner cover, and wherein an outer diameter of the at least one sealing protrusion is smaller than an inner diameter of the second edge portion.

19. The cosmetic container of claim 17, wherein the at least one sealing protrusion has a plurality of coupling protrusions defined on an outer side surface of the at least one sealing protrusion.

20. The cosmetic container of claim 19, wherein the at least one sealing protrusion in a circumferential direction, wherein an air vent is a space on the at least one sealing protrusion, and the space is defined by discontinuous adjacent coupling protrusions, and wherein the inner side surface of the second edge portion has a plurality of coupling grooves, which are configured to accommodate the plurality of coupling protrusions, respectively when the sealing portion is coupled to the inner container.

* * * * *